US011725486B2

(12) United States Patent
Utter et al.

(10) Patent No.: US 11,725,486 B2
(45) Date of Patent: Aug. 15, 2023

(54) SYSTEMS AND METHODS FOR DOWNHOLE DEPLOYMENT OF CONTAINERS

(71) Applicant: Schlumberger Technology Corporation, Sugar Land, TX (US)

(72) Inventors: Robert Utter, Sugar Land, TX (US); Rod Shampine, Houston, TX (US); Dmitriy Potapenko, Sugar Land, TX (US); Yu Wang, Beijing (CN); Iain Cooper, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/293,618

(22) PCT Filed: Nov. 14, 2019

(86) PCT No.: PCT/US2019/061480
§ 371 (c)(1),
(2) Date: May 13, 2021

(87) PCT Pub. No.: WO2020/102534
PCT Pub. Date: May 22, 2020

(65) Prior Publication Data

US 2022/0010656 A1 Jan. 13, 2022

Related U.S. Application Data

(60) Provisional application No. 62/767,297, filed on Nov. 14, 2018.

(51) Int. Cl.
*E21B 41/00* (2006.01)
*E21B 23/14* (2006.01)
(Continued)

(52) U.S. Cl.
CPC ..... *E21B 41/005* (2013.01); *E21B 23/14* (2013.01); *G21F 5/14* (2013.01); *G21F 9/34* (2013.01)

(58) Field of Classification Search
CPC ..... E21B 41/005; E21B 23/14; G21F 5/14; G21F 9/34
See application file for complete search history.

(56) References Cited

U.S. PATENT DOCUMENTS 3,135,328 A * 6/1964 Cherry ..... E21B 23/06 166/125
3,760,753 A * 9/1973 Mertens ..... B65D 88/78 976/DIG. 388

(Continued)

FOREIGN PATENT DOCUMENTS

EP 2840226 A2 2/2015
WO 2008100362 A2 8/2008

OTHER PUBLICATIONS

International Search Report and Written Opinion issued in the related PCT application PCT/US2019/061480, dated Apr. 29, 2020 (14 pages).

(Continued)

*Primary Examiner* — D. Andrews
(74) *Attorney, Agent, or Firm* — Frederick Carbone

(57) ABSTRACT

A downhole tool system may include one or more containers to hold waste product and a tractor to convey the one or more containers to a storage location within a wellbore. The downhole tool system may also include an anchor to seal against the wellbore and secure the containers at the storage location. Additionally, the downhole tool system may include a disconnect tool to separate the tractor from the containers such that the tractor may be removed from the wellbore while leaving the containers at the storage location.

13 Claims, 4 Drawing Sheets

(51) Int. Cl.
*G21F 5/14* (2006.01)
*G21F 9/34* (2006.01)

(56) References Cited

U.S. PATENT DOCUMENTS

| | | | | |
|---|---|---|---|---|
| 4,377,509 | A | 3/1983 | Haynes et al. | |
| 11,289,226 | B2 * | 3/2022 | Crichlow | G21F 5/008 |
| 2004/0067328 | A1 * | 4/2004 | Taniuchi | G21F 5/005 428/34.4 |
| 2011/0234378 | A1 | 9/2011 | Radley et al. | |
| 2017/0186505 | A1 * | 6/2017 | Muller | G21F 9/165 |
| 2017/0350237 | A1 * | 12/2017 | Giem | E21B 23/01 |
| 2018/0216458 | A1 | 8/2018 | Garcia et al. | |

OTHER PUBLICATIONS

International Preliminary Report on Patentability issued in the related PCT application PCT/US2019/061480 dated May 27, 2021, 9 pages.

* cited by examiner

SYSTEMS AND METHODS FOR DOWNHOLE DEPLOYMENT OF CONTAINERS

CROSS REFERENCE PARAGRAPH

This application claims the benefit of U.S. Provisional Application No. 62/767,297, entitled "SYSTEMS AND METHODS FOR DOWNHOLE DEPLOYMENT OF CONTAINERS," filed Nov. 14, 2018, the disclosure of which is hereby incorporated herein by reference.

BACKGROUND

This disclosure relates generally to systems and methods for deployment of waste containers, such as nuclear waste canisters, downhole.

Waste product such as nuclear waste may be generated by various processes (e.g., medical, industrial, and/or energy generation) and include radioactive materials that decay to give off nuclear radiation (e.g., alpha, beta, and/or gamma radiation). Such waste product may be stored underground to provide insulation from the nuclear radiation.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Waste product such as radioactive materials from industrial, medical, or energy production processes may be stored underground in wellbores to provide insulation from the nuclear radiation. Moreover, the waste product may be stored temporarily, for example until the nuclear radiation has substantially subsided, or stored indefinitely. In some embodiments, the depositing of the waste product into a wellbore may be accomplished before and/or during plugging of the wellbore. Moreover, the waste product may be carried down the wellbore via a wireline or slickline, for example, into a vertical, horizontal, or slanted section of the wellbore.

In some embodiments, a wellbore packer may be used to hold up or suspend one or more containers of the waste product within the wellbore at a designated location. The designated location may be chosen, for example, depending on the amount or type of radiation output from the waste product and/or geological properties of zones of the formation. Additionally, one or more sensors on or within the containers may monitor and communicate the state of the waste product, via a wired or wireless connection, to the surface. Measurements of the radiation output may be used to estimate when the aggregate of the waste product has or will reach an acceptable level of radiation and/or to monitor the integrity of the containers. Furthermore, the sensors may be powered by a power storage device (e.g., battery, capacitor, etc.) and/or by a power generation device for generating power using the waste product. For example, decay of the radioactive material may generate heat, which may, in turn, be converted to energy via a thermocouple or other suitable device. As will be appreciated, although discussed herein in the context of waste product and radioactive material, any desired substance or object may be deployed into the wellbore for term storage and/or monitoring within a wellbore using the discussed techniques.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
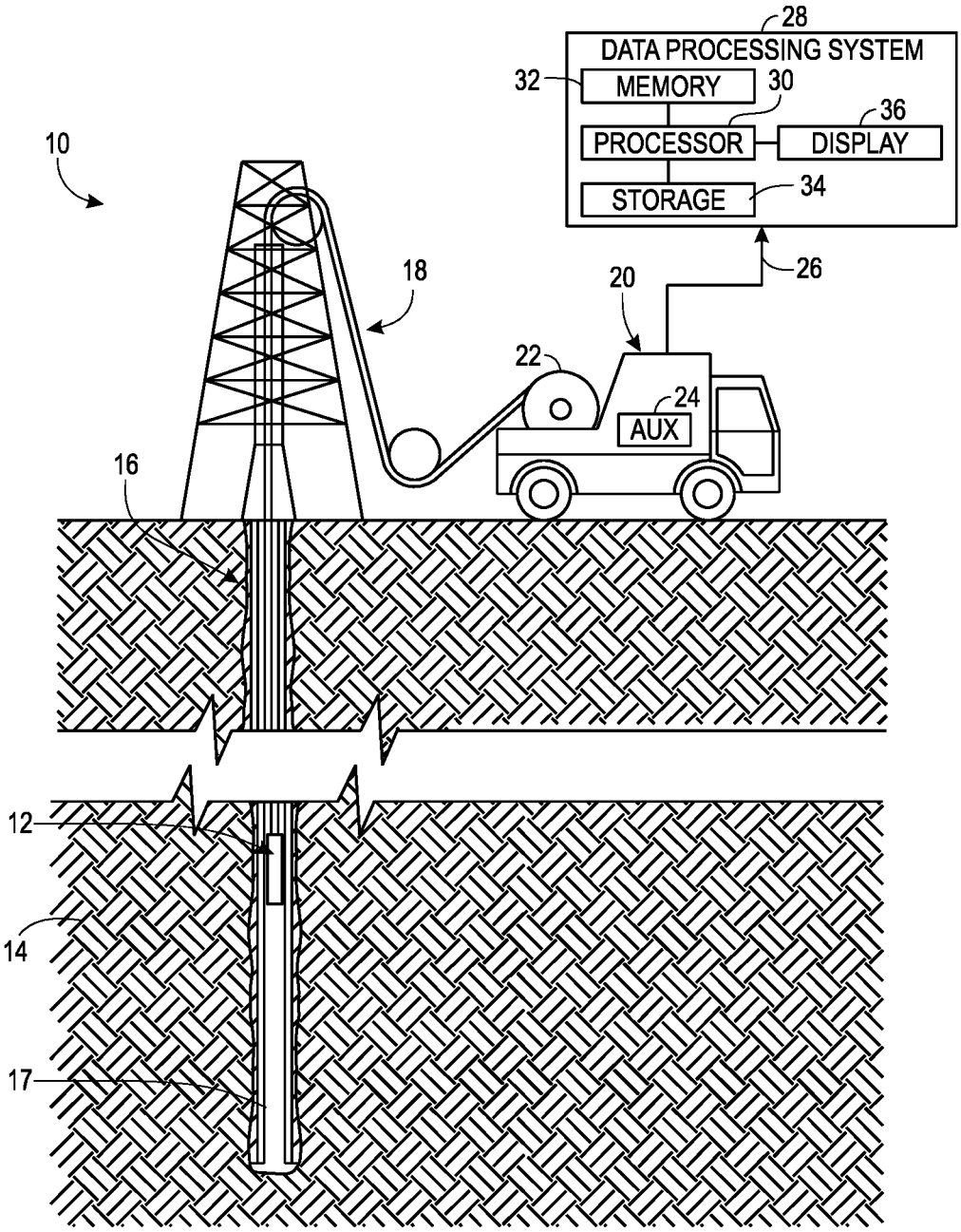
FIG. 1 is an example of a downhole assembly system, in accordance with an embodiment.

One or more specific embodiments of the present disclosure will be described below. These described embodiments are examples of the presently disclosed techniques. Additionally, in an effort to provide a concise description of these embodiments, the features of an actual implementation may not be described in the specification. It should be appreciated that in the development of any such actual implementation, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The oil and gas industry includes a number of sub-industries, such as exploration, drilling, logging, extraction, transportation, refinement, retail, and so forth. During exploration and drilling, wellbores may be drilled into the ground for reasons that may include discovery, observation, or extraction of resources. These resources may include oil, gas, water, or any other combination of elements within the ground.

Wellbores, sometimes called boreholes, may be straight or curved holes drilled into the ground from which resources may be discovered, observed, or extracted. Moreover, the wellbores may have horizontally drilled sections to increase production and/or efficiency. After the formation of a wellbore, well logging and production may be practiced. Well logging may include making a detailed record of the geological formations penetrated by a wellbore, and may also be practiced during creation (e.g., drilling) of the wellbore. Production may include the extraction of resources from within the wellbore.

If logging analysis determines that the wellbore has insufficient resources for extraction (e.g., extraction is not economical) or production has been completed, the wellbore may be plugged. Plugging the wellbore may include inserting or forming one or more plugs (e.g., cement plugs) within the wellbore. For example, a plug may be placed at the top of the wellbore proximate the surface (e.g., including the top 20-50 feet of the wellbore) and/or at various locations within the wellbore such as to isolate aquafers, hydrocarbon zones, and/or other layers of the formation. However, plugging of the wellbore may leave significant portions of wellbore empty. The space left within the wellbore may be used for the storage and monitoring of materials such as waste product (e.g., medical, chemical, and/or nuclear waste).

Waste product such as nuclear waste may be generated by various processes (e.g., medical, industrial, and/or energy generation) and include radioactive materials that decay to give off nuclear radiation (e.g., alpha, beta, and/or gamma radiation). Such waste product may be stored underground to provide secluded storage and/or insulation from the nuclear radiation. Moreover, the waste product may be stored temporarily, for example until the nuclear radiation has substantially subsided (e.g., after a suitable number of half-lives associated with the radioactive material such that the nuclear radiation expelled is within an acceptable level), or stored indefinitely. As will be appreciated, an "acceptable level" of radiation may be determined based on the amount of radioactivity, the type of radiation, and/or applicable laws, regulation, and/or industrial practices.

The depositing of the waste product, such as that described above, into a wellbore may be accomplished before and/or during plugging of the wellbore. The waste product may be carried down the wellbore via a wireline or slickline, for example, into a vertical, horizontal, or slanted section of the wellbore. In some embodiments, a packer may be used to hold up, suspend, or secure one or more containers of the waste product within the wellbore at a designated location. Moreover, the packer may assist in plugging the wellbore by creating a seal against the casing or wall of the wellbore. The designated location may be chosen, for example, depending on the amount or type of radiation output from the waste product and/or properties of the surrounding formation (e.g., proximity to the surface of the wellbore, aquafers, hydrocarbon zones, or other geological zones). Additionally, the designated location may be selected such that the BHA does not traverse an angle that may increase the bending stress above a yield stress of a container. Moreover, the wellbore may be chosen such that the containers may be transported to an angled or horizontal section without incurring such stress. Additionally, the wellbore may be initially drilled with the forethought of waste product storage.

Additionally, one or more sensors on or within the containers may monitor the waste product, for example by measuring the radiation output and/or location within the wellbore of the waste product, and communicate the state of the waste product, via a wired or wireless connection, to the surface. Measurements of the radiation output may be used to estimate when the aggregate of waste product has or will reach an acceptable level of radiation and/or the integrity of the containers. Furthermore, the sensors may be powered by a power storage device (e.g., battery, capacitor, etc.) and/or by a power generation device (e.g., thermocouple) for generating power using the waste product. For example, decay of the radioactive material may generate heat, which may, in turn, be converted to energy via a thermocouple or other suitable device. As will be appreciated, although discussed herein in the context of waste product and radioactive material, any desired substance or object may be deployed into the wellbore for term storage and/or monitoring within a wellbore using the discussed techniques.

With the foregoing in mind, FIG. 1 illustrates a wellbore tool system 10 that may employ the systems and methods of this disclosure. The wellbore tool system 10 may be used to convey a bottom-hole-assembly (BHA) 12 through a geological formation 14 via a wellbore 16. In some embodiments, the wellbore 16 may include a casing 17 to provide an annular structure throughout at least a portion of the wellbore 16. In the example of FIG. 1, the BHA 12 is conveyed on a cable 18 via a logging winch system (e.g., vehicle) 20. Although the logging winch system 20 is schematically shown in FIG. 1 as a mobile logging winch system carried by a truck, the logging winch system 20 may be substantially fixed (e.g., a long-term installation that is substantially permanent or modular). Any suitable cable 18 for well logging may be used. The cable 18 may be spooled and unspooled on a drum 22 and an auxiliary power source 24 may provide energy to the logging winch system 20 and/or the BHA 12.

Moreover, while the BHA 12 is described as a wireline assembly of downhole tools (e.g., a tool string), it should be appreciated that any suitable conveyance may be used. For example, the BHA 12 may instead be conveyed on a slickline, via coiled tubing, jointed piping, or other suitable means. For the purposes of this disclosure, the BHA 12 may be any suitable BHA 12 for conveying the waste product downhole. As discussed further below, the BHA 12 may include a propulsion device to move the BHA 12 through the wellbore 16 and a release mechanism for detaching the waste product containers.

Control signals 26 may be transmitted from a data processing system 28 to the BHA 12, and data signals 26 related to the movement, location, and or state of the BHA 12, including the waste product, may be returned to the data processing system 28 from the BHA 12. The data processing system 28 may be any electronic data processing system 28 that can be used to carry out the systems and methods of this disclosure. For example, the data processing system 28 may include a processor 30, which may execute instructions stored in memory 32 and/or storage 34. As such, the memory 32 and/or the storage 34 of the data processing system 28 may be any suitable article of manufacture that can store the instructions. The memory 32 and/or the storage 34 may be read-only memory (ROM), random-access memory (RAM), flash memory, an optical storage medium, or a hard disk drive, to name a few examples. A display 36, which may be any suitable electronic display, may display images generated by the processor 30. The data processing system 28 may be a local component of the logging winch system 20 (e.g., within the BHA 12 or logging winch system 20), a remote device that analyzes data from other logging winch systems 20, a device located proximate to the drilling operation, or any combination thereof. In some embodiments, the data processing system 28 may be a mobile computing device (e.g., tablet, smart phone, or laptop) or a server remote from the logging winch system 20.

As discussed above, the BHA 12 may include a tractor 38, a packer 40, a packer setting tool 42, a disconnect tool 44, one or more containers 46, and/or a combination thereof, as illustrated in FIGS. 2A, 2B, 2C, and 2D. Furthermore, the components of the BHA 12 may be connected via any suitable tool string connections 48, which may include, for example, structural cables, tubular sections (e.g., pipes), and/or pipe joints, as well as fluid (e.g., gas or liquid) connections (e.g., pneumatic or hydraulic) and/or electrical connections. Moreover, the tool string connections 48 may include flexible joints to reduce bending forces and/or strain on the containers 46 or other BHA components, for example through curved sections of the wellbore 16.

The tractor 38 may be used to propel the BHA 12 through the wellbore 16 and may be any suitable type of tractor 38 for conveying the BHA 12 through the wellbore 16. For example, the tractor 38 may include one or more motors, wheels, spurs, and/or arms to convey the BHA 12 through a casing 17 of the wellbore 16, through a non-cased wellbore 16, or include capabilities for moving along both cased and non-cased wellbores 16. As such, the tractor 38 may be any suitable tool for propelling the BHA 12 through the wellbore 16. In some embodiments, gravity may assist the BHA 12 into and down the wellbore 16 with or without the assistance of the tractor 38. Moreover, the tractor 38 may provide propulsion in vertical, slanted, or horizontal sections of the wellbore 16.

The packer 40 may seal against the walls of the wellbore 16 or casing 17 to provide a stationary support for the containers 46 of the waste product. The packer 40 may be placed within the wellbore 16 for permanent or temporary use. For example, in one embodiment, a packer 40 may seal against a casing 17 of a wellbore 16 by permanently deforming an elastomeric material (e.g., by axially compressing an annular seal of elastomeric material) until the seal is made. Moreover, such a packer 40 may utilize easily drillable parts (e.g., plastic or aluminum parts) in case removal of the packer 40 is desired. Furthermore, in some embodiments, a removable packer 40 may be implemented within the wellbore 16. In one embodiment, the removable packer 40 may pump fluid into a bladder to seal against the casing 17 or wall of the wellbore 16, and removal of the removable packer 40 may be accomplished by deflating the bladder. In some embodiments, the packer setting tool 42 may be used to set the packer 40 in place. For example, the packer setting tool 42 may pump fluid into the bladder of the packer 40 or provide a means for sealing the elastomeric material against the casing 17 or wall of the wellbore 16. Other suitable anchoring tools (e.g., a slip assembly, profile latching assembly, etc.), either permanent or temporary, may also be used in conjunction with or instead of the packer 40.

Additionally, the packer 40 or other sealing device may also provide a seal for use in plugging the wellbore 16. In some embodiments, the BHA 12 may also include a pressure test system to verify the seal in the wellbore 16. The pressure test system may include one or more probes, pressure sensors, force sensors, and/or a means for applying a pressure or force. In some embodiments, the pressure test system may be included, at least partially, within the packer setting tool 42. Verification of the seal may assist in the plugging of the wellbore 16 and/or securement of the containers 46. Additionally or alternatively, sensors may be integrated into the wellbore 16 and/or casing 17 to facilitate verification of the seal. Moreover, an annulus (e.g., the space between the casing 17 and the wellbore, the space between the BHA 12 and the casing 17, and/or the space between the BHA 12 and the wall of the wellbore 16) of the wellbore 16 may be filled with a material (e.g., de-ionized water, brine, silicone fluid, glycol, etc.) chosen to improve the robustness of the measurements made within the wellbore 16.

Figure 2A:
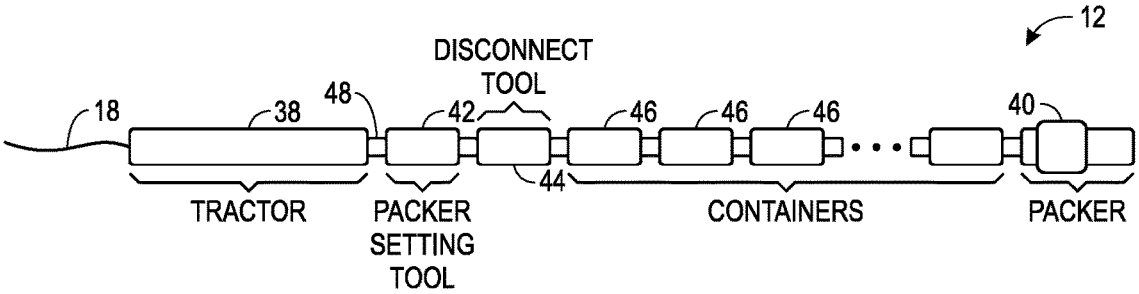
FIG. 2A is a schematic view of an example bottom-hole-assembly (BHA) for carrying and depositing waste containers downhole, in accordance with an embodiment.
Figure 2B:
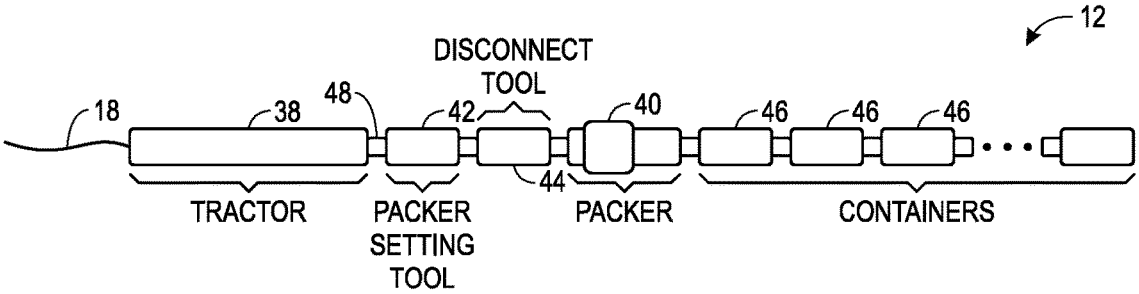
FIG. 2B is a schematic view of an example BHA for carrying and depositing waste containers downhole, in accordance with an embodiment.
Figure 2C:
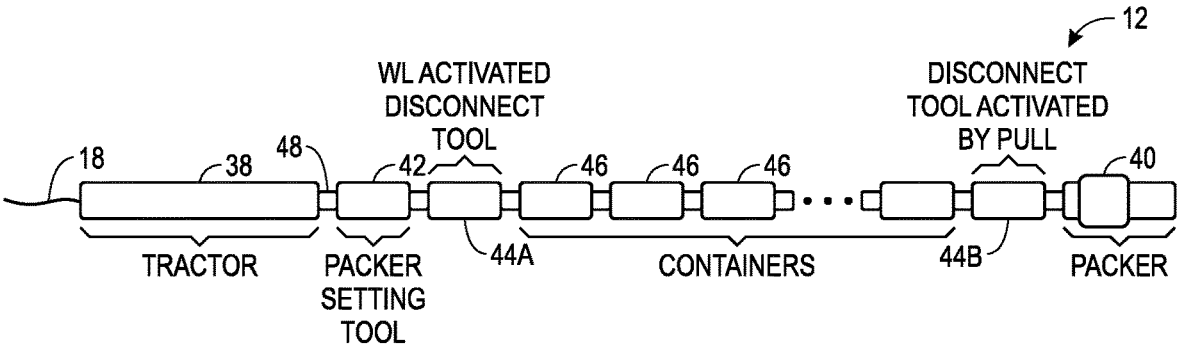
FIG. 2C is a schematic view of an example BHA for carrying and depositing waste containers downhole, in accordance with an embodiment.
Figure 2D:
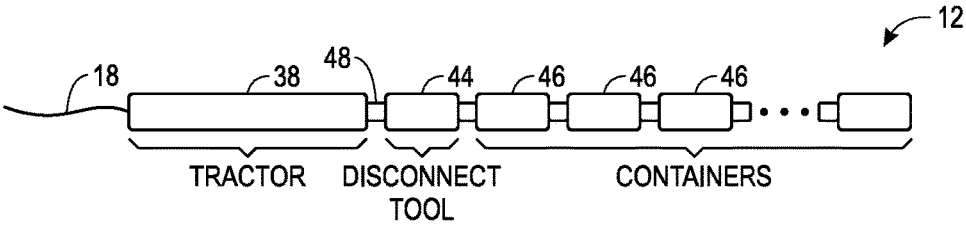
FIG. 2D is a schematic view of an example BHA for carrying and depositing waste containers downhole, in accordance with an embodiment.

As illustrated in FIGS. 2A and 2B, the containers 46 may be implemented before or after (e.g., relative to insertion into the wellbore 16) the packer 40. The packer 40 may hold the containers 46 at the designated position within the wellbore 16 after removal of the tractor 38 and/or other downhole tools. Moreover, in some embodiments, such as illustrated in FIG. 2D, no packer 40 is used. For example, the containers 46 may be placed in a horizontal portion of the wellbore 16 without a securement to the formation 14.

The disconnect tool 44 may allow for separation of the tractor 38 and/or other downhole tools such as the packer setting tool 42 from the containers 46. As such, the tractor 38 may be removed from the wellbore 16 while leaving the containers 46 behind. In some embodiments, the BHA 12 may include a wireline activated disconnect tool 44A, a pull activated disconnect tool 44B, or both. The wireline activated disconnect tool 44A may be operated via the cable 18, for example by an operator on the surface of the formation 14, and minimal resistance may be incurred when separating. The pull activated disconnect tool 44B may separate under a tensile force (e.g., greater than 500 pounds, greater than 5000 pounds, or a configurable threshold) corresponding to the pull activated disconnect tool 44B. In some embodiments, the pull activated disconnect tool 44B may also include an operator controllable lock to keep the pull activated disconnect tool 44B from separating prematurely. In some embodiments, the disconnect tool 44 may include a re-connection fitting to facilitate latching onto the containers 46 after deployment. Further, in some embodiments, the re-connection fitting may be configurable to connect to a particular mating device to minimize and/or prevent unauthorized retrieval. For example, the re-connection fitting and/or mating device may be non-standard in the field of oil and gas exploration and extraction. Furthermore, in some embodiments, the re-connection fitting and mating device may join via a lock-and-key type connection, where the re-connection fitting attached to the containers 46 and/or packer 40 rejects mating devices without an appropriate key.

As discussed above, the containers 46 of waste product may be stored in the wellbore 16 indefinitely or retrieved at a later time. For example, the containers 46 may be retrieved after the radiation has substantially subsided, if the wellbore 16 is to be repurposed, and/or if integrity of one or more of the containers 46 is suspected to be inadequate to contain the waste product. As illustrated by FIGS. 2A-2D, deployment and/or retrieval of the containers 46 may vary depending on implementation. For example, in the illustrated embodiment of FIG. 2C, the containers 46 are on top of, relative to the bottom of the wellbore 16, the packer 40. In some embodiments, the packer 40 may be set and the wireline activated disconnect tool 44A activated to deploy the containers 46. Upon retrieval, the containers 46 may be latched onto, for example by a downhole retrieval system, and pulled until the pull activated disconnect 44B detaches, leaving the packer 40 in place. In another embodiment, such as in FIG. 2B, retrieval may include removal of the packer 40, for example, by drilling it out or deflation of the seal. Additionally or alternatively, the packer 40 and/or disconnect tool 44 may be dislodged or unlatched by a set down force, a rotational force, and/or the influx or removal of a pumped fluid.

Figure 3A:
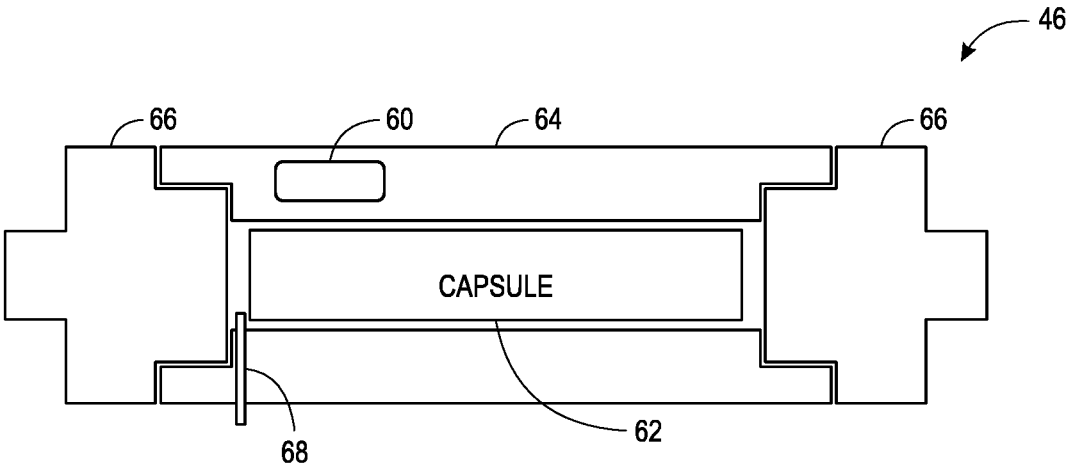
FIG. 3A is an example container for use in the BHA of FIGS. 2A-2D, in accordance with an embodiment.
Figure 3B:
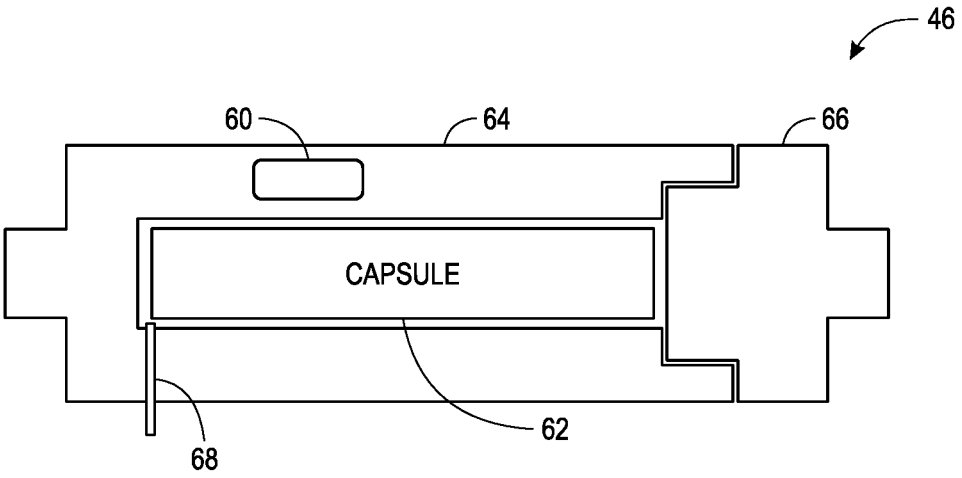
FIG. 3B is an example container for use in the BHA of FIGS. 2A-2D, in accordance with an embodiment.

Between deployment and retrieval, the containers 46 and the waste product within may be monitored, for example, by a sensor system 60 of one or more sensors on one or more of the containers 46, as shown in FIGS. 3A and 3B. The sensors may measure the state of the waste product, and/or the integrity of the containers 46, for example, by measuring the radioactive output of the waste product, within the containers 46, outside the containers 46, or both. For example, if the radiation level outside a container 46 exceeds a threshold relative to the radiation level within the container 46 it may indicate that the integrity of the container 46 may be diminished. Additionally, the sensor system 60 may include a power source such as a battery, capacitor, or other energy storage device. In some embodiments, the sensor system 60 may be powered by the cable 18, while connected. Furthermore, the sensor system 60 may also include a power generation device to obtain power, for example, from the waste product. For example, the sensor system 60 may include one or more thermocouples or other suitable devices for converting energy associated with the radioactive decay (e.g., heat energy) into electric current. The sensor system 60 may wirelessly transmit the state of the containers 46 and/or waste product to the surface.

Additional sensors may be implemented at the surface of the wellbore 16 to receive wireless signals from the one or more sensor systems 60, such as part of the data processing system 28. Furthermore, additional sensors may be used to determine where the containers 46 are relative to the bottom of the wellbore 16, packers 40, other containers 46, and/or other tools or structures within the wellbore 16. Additionally or alternatively, the sensor system 60 may be programmed with information relating to the containers 46 position within the wellbore 16, and wirelessly transmit the information with the state of the containers 46.

In some embodiments, the container 46 may include an inner capsule 62 containing the waste product. Moreover, multiple layers of containment may be utilized for radioactive shielding and/or containment of the waste product. As such, the container 46 may be implemented as a vessel for the capsule 62 of waste product. The container 46 may include a housing 64 and a single cap 66, as shown in FIG. 3A, or multiple caps 66, such as shown in FIG. 3B, to contain the capsule 62. The caps 66 may be affixed to the housing 64 by any suitable means such as welding, riveting, and/or threading, and leak tested prior to deployment. In some embodiments, the housing 64 and/or caps 66 may provide at least a portion of the radiation shielding. Additionally or alternatively, shielding layers may be placed between the housing 64 and/or caps 66 and the capsule 62 to provide additional shielding. Additionally, the housing 64 and/or caps 66 may have connections for attaching the container 46 to the BHA 12 and/or other containers 46. In some embodiments, the container 46 may also include a pressure equalization device 68 (e.g., pressure regulated valves, check valves, etc.) to equalize the pressure inside with container 46 and/or capsule 62 to that of the surroundings (e.g., the wellbore 16).

Figure 4:
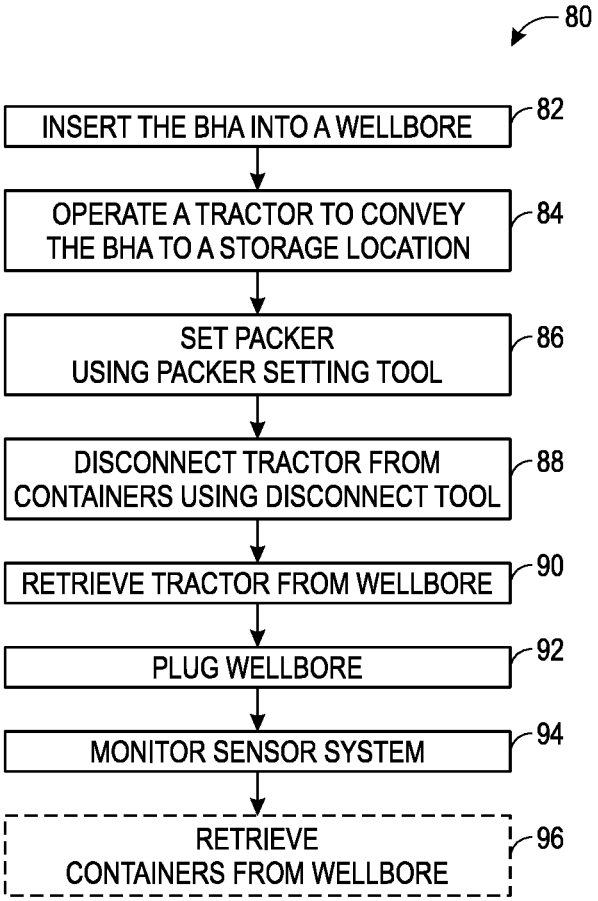
FIG. 4 is a flowchart of an example process for deploying, monitoring, and retrieving one or more containers of waste product, in accordance with an embodiment.

FIG. 4 is a flowchart 80 of an example process for deploying, monitoring, and retrieving one or more containers 46 of waste product. The process may include inserting a BHA 12 into a wellbore 16 (process block 82) and operating a tractor 38 to convey the BHA 12 to a storage location (process block 84). At the storage location, the packer 40 may be set, for example, using the packer setting tool 42 (process block 86). The tractor 38 may be disconnected from the containers 46 using the disconnect tool 44 (process block 88) and retrieved from the wellbore 16 (process block 90). In some embodiments, the wellbore 16 may be plugged (process block 92), for example, after deployment of the containers 46. The sensor system 60 of the one or more containers 46 may be monitored, for example periodically or continuously, to determine the state of the waste product and/or containers 46 (process block 94). The containers 46 may also be retrieved from the wellbore 16 if desired (process block 96). Furthermore, in some embodiments, multiple separate deployments of containers 46 may occur in the same wellbore 16 employing the same or different BHA implementations.

Although the above referenced flowchart 80 is shown in a given order, in certain embodiments, the depicted steps may be reordered, altered, deleted, and/or occur simultaneously. Additionally, the referenced flowchart 80 is given as an illustrative tool, and further decision and/or process blocks may be added depending on implementation.

The specific embodiments described above have been shown by way of example, and it should be understood that these embodiments may be susceptible to various modifications and alternative forms. It should be further understood that the claims are not intended to be limited to the particular forms disclosed, but rather to cover modifications, equivalents, and alternatives falling within the spirit and scope of this disclosure.

The invention claimed is:

1. A downhole tool system comprising:

a container configured to contain waste product;

a tractor configured to convey the container to a storage location within a wellbore;

an anchor configured to seal against the wellbore and secure the container at the storage location, wherein the container is configured to be coupled between the tractor and the anchor;

a first disconnect tool configured to separate the tractor from the container such that the tractor may be removed from the wellbore while leaving the container at the storage location; and a second disconnect tool configured to release the container from the anchor in response to a tensile force.

2. The downhole tool system of claim 1, wherein the container is configured to be coupled to a second container and the anchor via flexible joints.

3. The downhole tool system of claim 1, wherein the waste product comprises radioactive waste.

4. The downhole tool system of claim 1, wherein the container comprises a sensor system configured to monitor radioactive activity of the waste product.

5. The downhole tool system of claim 4, wherein the sensor system comprises a wireless transmitter configured to send data comprising the radioactive activity of the waste product to a surface of the wellbore.

6. The downhole tool system of claim 4, wherein the sensor system is configured to determine an integrity of the container based at least in part on the monitored radioactive activity.

7. The downhole tool system of claim 1, wherein the anchor is configured to provide a seal between a first formation zone and a second formation zone.

8. The downhole tool system of claim 1, wherein the anchor comprises a packer.

9. The downhole tool system of claim 1, comprising an anchor setting tool configured to:

facilitate sealing the anchor against the wellbore; and test the sealing of the anchor for integrity.

10. The downhole tool system of claim 1, wherein the container comprises a pressure regulator configured to equalize a first gas pressure at the storage location in the wellbore and a second gas pressure within the container.

11. A method comprising:

conveying, via a cable, a downhole tool system into a wellbore, wherein the downhole tool system comprises a container configured to contain radioactive waste, a first disconnect tool, a second disconnect tool, and an anchor;

disconnecting the cable from at least the container of the downhole tool system using the first disconnect tool;

removing the cable from the wellbore;

plugging the wellbore; and retrieving the container from the wellbore, wherein retrieving the container from the wellbore comprises releasing the container from the anchor by applying a tensile force to the second disconnect tool.

12. The method of claim 11, comprising:

monitoring, via a sensor system, radioactivity of the radioactive waste; and determining an integrity of the container.

13. The method of claim 11, wherein the anchor is configured to secure the container at a location within the wellbore, the method further comprising plugging, via the anchor, the wellbore at the location.

* * * * *